US008100303B2

(12) United States Patent
Parve

(10) Patent No.: US 8,100,303 B2
(45) Date of Patent: Jan. 24, 2012

(54) CLOSURE FOR A CONTAINER

(75) Inventor: Terrence M. Parve, Menomonee Falls, WI (US)

(73) Assignee: Gatewat Plastics, Inc., Mequon, WI (US)

( * ) Notice: Subject to any disclaimer, the term of this patent is extended or adjusted under 35 U.S.C. 154(b) by 1542 days.

(21) Appl. No.: 11/317,649

(22) Filed: Dec. 23, 2005

(65) Prior Publication Data

US 2007/0145082 A1 Jun. 28, 2007

(51) Int. Cl.
*B67D 3/00* (2006.01)

(52) U.S. Cl. ..... 222/480; 222/546; 222/556; 222/565; 220/254.2; 220/287; 215/319

(58) Field of Classification Search ..... 222/480, 222/546, 556, 565, 142.1, 142.4, 498, 527, 222/530, 533, 534, 536; 220/254.2, 254.3, 220/287; 215/316, 319, 343, 344, 346
See application file for complete search history.

(56) References Cited

U.S. PATENT DOCUMENTS

| | | | | |
|---|---|---|---|---|
| 893,469 | A * | 7/1908 | Essmuller | 215/319 |
| 3,117,701 | A * | 1/1964 | Stull | 222/543 |
| 3,317,069 | A * | 5/1967 | Chin | 215/353 |
| 3,606,074 | A * | 9/1971 | Hayes | 220/212 |
| 3,788,510 | A * | 1/1974 | Collins | 215/341 |
| 4,881,668 | A * | 11/1989 | Kitterman et al. | 222/482 |
| 5,219,100 | A * | 6/1993 | Beck et al. | 222/480 |
| 6,460,718 | B1 * | 10/2002 | Vogel | 220/254.2 |
| 7,909,212 | B2 * | 3/2011 | Parve | 222/480 |
| 2003/0071041 | A1 * | 4/2003 | Vogel | 220/254.2 |
| 2003/0090036 | A1 * | 5/2003 | Vogel | 264/322 |
| 2004/0226950 | A1 * | 11/2004 | Samz et al. | 220/254.2 |
| 2007/0145082 | A1 * | 6/2007 | Parve | 222/480 |
| 2008/0257918 | A1 * | 10/2008 | Vogel et al. | 222/480 |

* cited by examiner

*Primary Examiner* — J Jacyna
(74) *Attorney, Agent, or Firm* — Foley & Lardner LLP

(57) ABSTRACT

A closure for a container is disclosed having a body, a top portion, and a transition region. The body has a cylindrical skirt and an end wall. The cylindrical skirt has a first end coupled to the end wall and a second open end configured to receive a receptacle. The top portion is coupled to the end wall of the body portion and has a flap movable from a closed position where the opening is covered to an open position where the opening is at least partially uncovered. The transition region has an exposed surface and is located at a juncture between the end wall and the side wall. The exposed surface extends from a first point on the end wall radially inward from the skirt to a second point on the skirt below the end wall and below the first point.

36 Claims, 11 Drawing Sheets

CLOSURE FOR A CONTAINER

FIELD

The present invention relates to a closure for a container for storing and dispensing materials. The present invention more specifically relates to a closure having one or more flaps for enclosing one or more openings in the closure.

CROSS REFERENCE TO RELATED APPLICATIONS

The following patents and patent applications are hereby incorporated by reference: International Patent Application No. PCT/2005/031562, filed Sep. 3, 2005; U.S. Provisional Patent Application No. 60/607,787, filed Sep. 5, 2004; U.S. Provisional Patent Application No. 60/618,087, filed Oct. 12, 2004; U.S. Provisional Patent Application No. 60/435,482, filed Dec. 12, 2002; U.S. application Ser. No. 10/435,653, filed May 9, 2003; U.S. application Ser. No. 10/234,441, filed Sep. 3, 2002; U.S. application Ser. No. 10/740,176, filed Dec. 18, 2003; U.S. application Ser. No. 09/663,874, filed Sep. 15, 2000, now U.S. Pat. No. 6,460,718; U.S. application Ser. No. 09/374,976, filed Aug. 16, 1999, now U.S. Pat. No. 6,250,517; U.S. application Ser. No. 08/959,399, filed Oct. 28, 1997, now U.S. Pat. No. 5,971,231; U.S. application Ser. No. 29/170,214, filed Nov. 1, 2002; U.S. application Ser. No. 29/170,146, filed Nov. 1, 2002; U.S. application Ser. No. 10/751,709, filed Jan. 5, 2004; U.S. application Ser. No. 09/728,654, filed Dec. 1, 2000, now U.S. Pat. No. 6,464,113; U.S. application Ser. No. 09/840,564, filed Apr. 23, 2001, now U.S. Pat. No. 6,308,870; U.S. application Ser. No. 10/020,581, filed Dec. 14, 2001, now U.S. Pat. No. 6,691,901.

BACKGROUND

It is generally known to provide covers or closures on plastic containers used for storing and dispensing particulate matter (e.g., granulated, powdered, etc.) or other materials, particularly foodstuffs, seasonings, etc. such as those displayed and sold in supermarkets. Such known closures typically have several openings, particularly several shaker openings, on one side of the closure and a spoon opening on an opposite side of the closure. Such known closures generally include a hinged flap for the shaker openings and a hinged flap for the spooning opening that are configured to close or seal these openings. Such known closures also typically include a sealing surface or ring on the inside of the closure that is configured to compress a liner or other sealing material between a mouth of the receptacle and the sealing ring to provide an air-tight seal.

In many cases, a particular closure design may be used for a variety of different receptacles. For a number of reasons, such as different manufacturers, manufacturing tolerances, the ability of the receptacle to receive an additional sifting disk, etc., different receptacles may apply different forces to a closure. In some cases, the magnitude and location of the forces applied to the closure may create a situation in which the end wall of the closure is forced into a substantially domed shape that adversely affects the operation of the closure. Thus, the different receptacles with which a closure may be used may be unduly limited.

Accordingly, it would be advantageous to provide a closure for a container that has a closure structure or system for holding the flaps closed. It also would be advantageous to provide a closure for a container that minimizes "sifting" or other leakage of the contents of the container from the closure when the flaps are in a closed position. It would be further advantageous to provide a closure for a container that operates consistently and effectively when coupled to a variety of different receptacles.

Accordingly, it would be advantageous to provide a closure for a container providing any one or more of these or other advantageous features.

DETAILED DESCRIPTION

Figure 1:
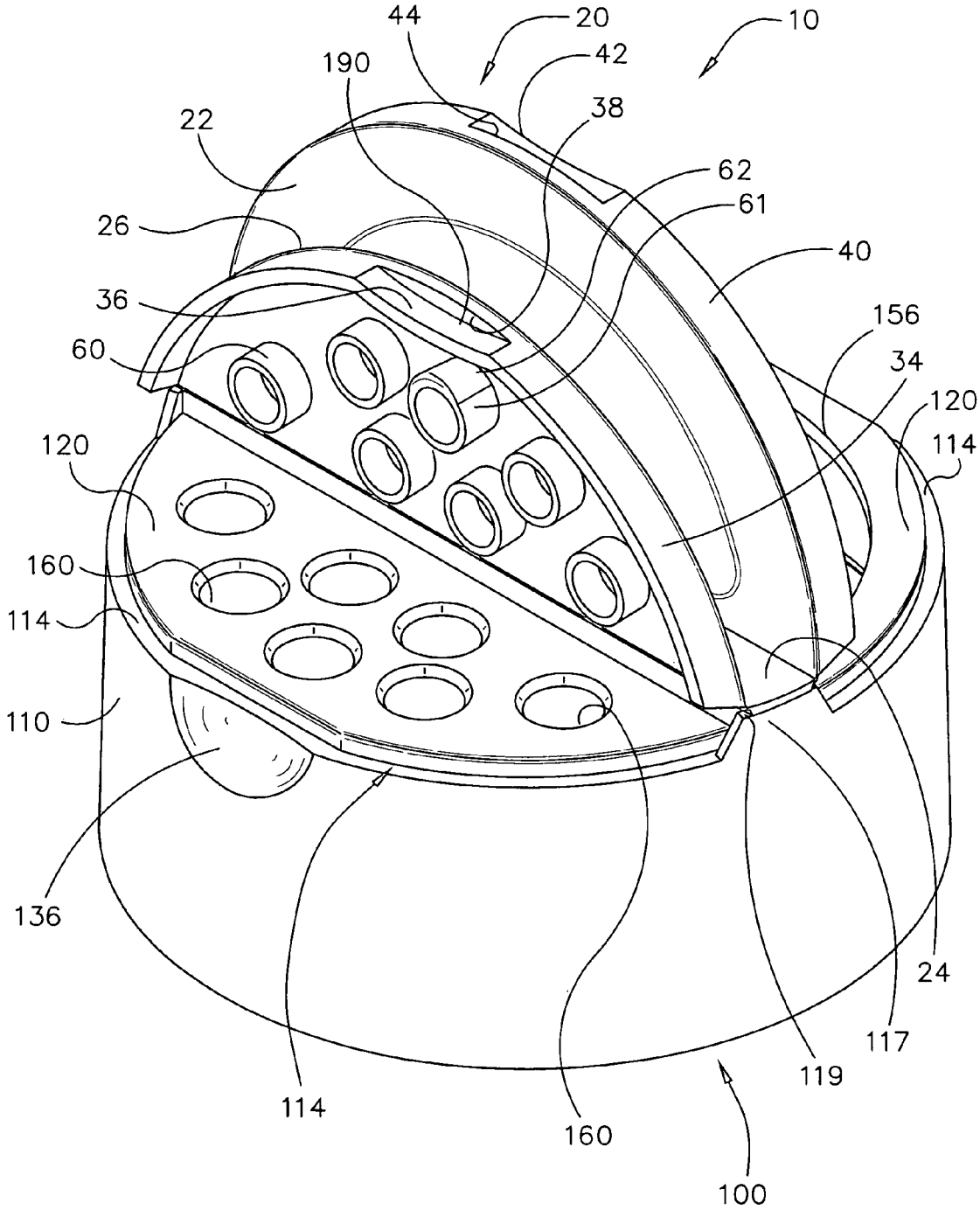
FIG. 1 is a schematic representation of a top perspective view of a shaker side of a closure for a container with flaps in an open position according to one embodiment.

Referring to the FIGURES, a cover or closure for a container is shown according to various exemplary embodiments. According to a preferred embodiment, closure 10 comprises a body shown as body portion 100 and a cover shown as top portion 20. Body portion 100 comprises a side wall section shown as cylindrical skirt 110 and an end wall section shown as generally planar top surface 120 (e.g., platform, top, top surface, etc.). Top surface 120 comprises two sections; in a first section (or side) a plurality of cylindrical (shaker) openings 160 are provided; in a second section (or side) a single generally semi-circular opening 156 is provided. Top surface 120 also comprises a plurality of apertures 172 located between shaker openings 160 and spoon opening 156 (in a central region or mid-section 170) intended to operate as a receiving structure.

Body portion 100 comprises a sealing structure shown as a plurality of cylindrical sealing rings 180 configured to provide an interface with a receptacle on which the closure is mounted. According to any preferred embodiment, the sealing structure can be configured to provide a suitable "seal" with the receptacle and/or a liner which may be provided between the seal structure and the mouth of the receptacle as shown, for example, in U.S. Pat. Nos. 4,714,181 and 6,460,718. Body portion 100 also comprises an area of transition between the sealing structure and the side wall section shown as transition region 178 that is configured to rigidify body portion 100 to help resist deformation that may otherwise occur as a result of forces applied to the closure when it is coupled to a receptacle.

Top portion 20 comprises a shaker flap 26 configured to expose shaker openings 160 when shaker flap 26 is in an open position and to cover shaker openings 160 when shaker flap 26 is in the closed position. Top portion 20 also comprises a spoon flap 22 configured to expose spoon opening 156 when spoon flap 22 is in the open position and to cover spoon opening 156 when spoon flap 22 is in the closed position. Top portion 20 further comprises a central region 24 (e.g., mid-section, web, etc.) having a first side 80 defining a shaker flap hinge 82 and a second side 84 defining a spoon flap hinge 86. The underside of central region 24 of top portion 20 comprises an engaging structure (shown schematically as coupling structure 70) configured to engage the plurality of coupling apertures 172 in body portion 100 to secure top portion 20 to body portion 100. According to various exemplary and alternative embodiments, the body portion and the top portion may be formed or otherwise made in separate molds or molding operations and assembled to form the closure, or they may be integrally formed as a single unitary body in the same mold or molding operation. According to various alternative embodiments, the top portion and body portion may be made in any suitable mold by any suitable molding operation.

Figure 2:
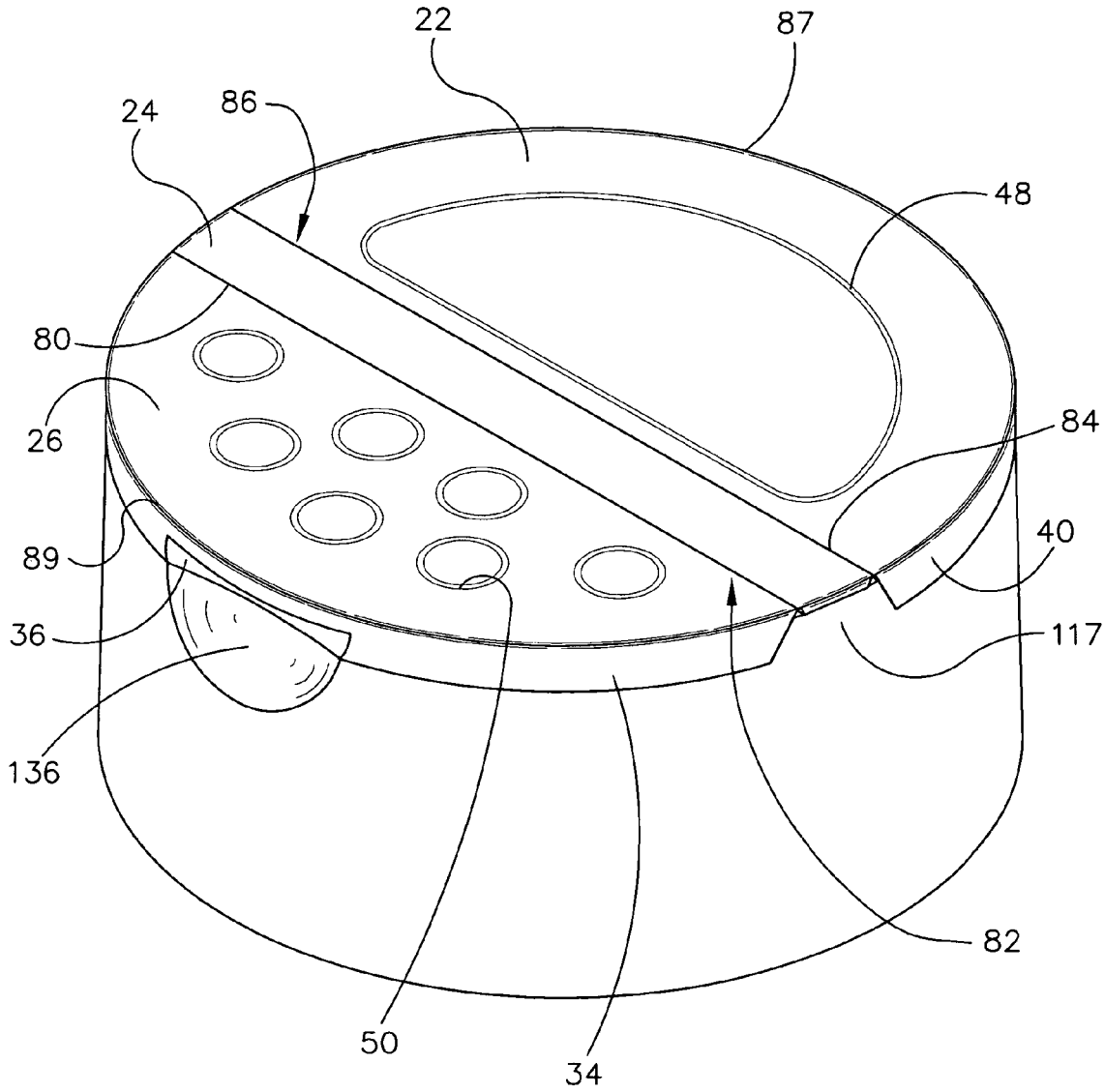
FIG. 2 is a schematic representation of a top perspective view of a shaker side of a closure for a container with flaps in a closed position according to the embodiment of FIG. 1.
Figure 3:
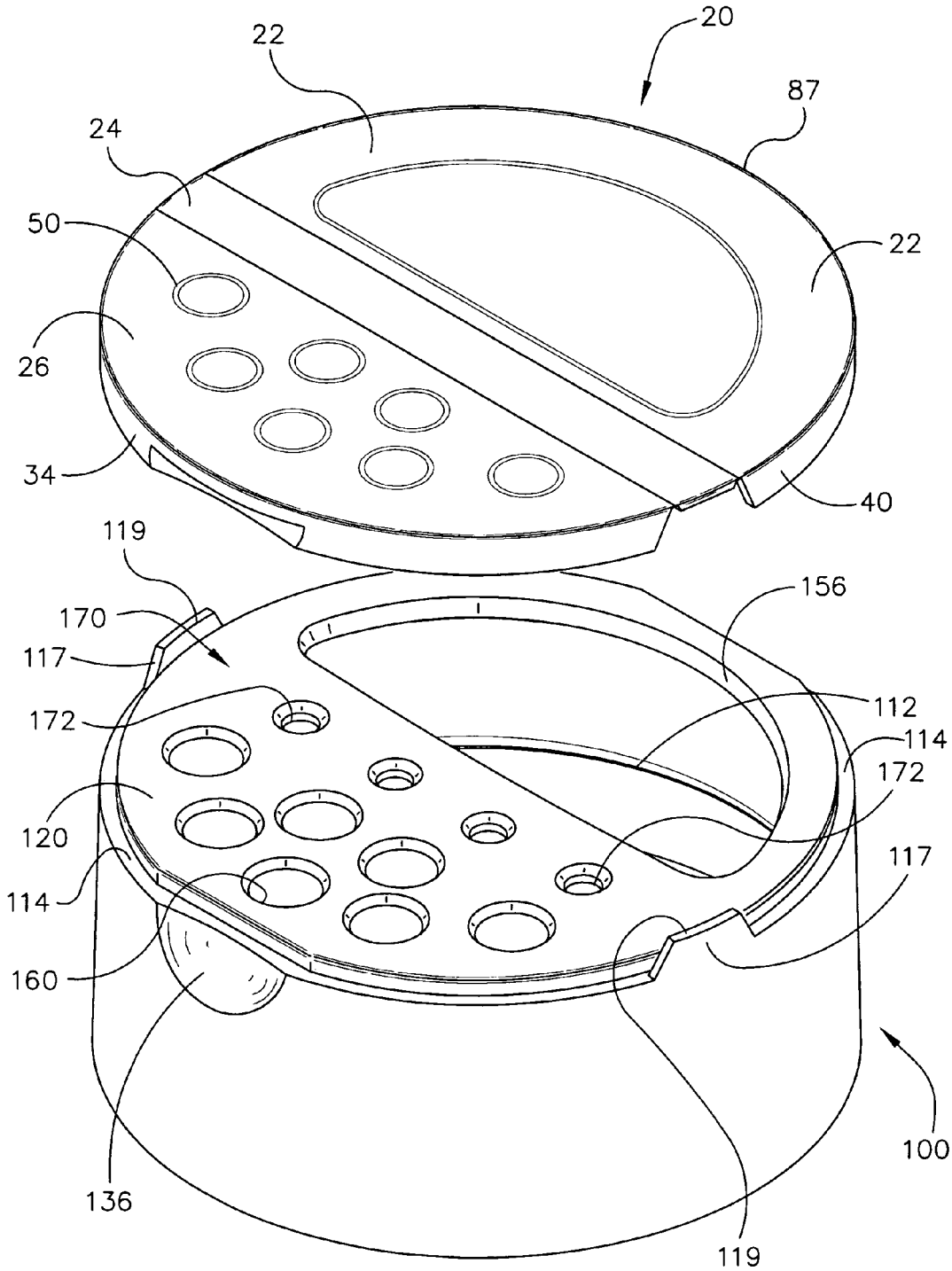
FIG. 3 is a schematic representation of a top exploded perspective view of a shaker side of a closure for a container having a body portion and a top portion according to the embodiment of FIG. 1.

Referring now to FIGS. 1 through 5 and 7A through 8, body portion 100 of the closure 10 is shown according to an exemplary embodiment. Body portion 100 has a side wall section 110 (e.g., skirt) adapted to fit over an end of a conventional receptacle (not shown). According to one exemplary embodiment, side wall section 110 is cylindrical and has a coupling component (e.g., attachment structure) (shown schematically as threads 112 in FIGS. 4 and 5) located on an inside surface for engaging a corresponding coupling component (e.g., threads, etc.) on the receptacle to secure closure 10 to an open end of the receptacle. According to various alternative and exemplary embodiments, the coupling component may be any suitable structure (e.g., press-on rings or snap-fit structure, ribs, etc.) for coupling the closure to the receptacle. Side wall 110 comprises a recess 114 (e.g., cut-out, step, ledge, etc.) along an upper perimeter of side wall 110 and adjacent to an outer edge of end wall 120. Recess 114 is configured to receive a downwardly extending skirt 34 from shaker flap 26 and a downwardly extending skirt 40 from spoon flap 22 (as shown in FIGS. 1 through 3). Side wall 110 also comprises indentations 136 and 142 on opposite sides of body portion 100 (shown schematically in FIGS. 1 through 5) that are configured to provide curved (e.g., concave) surfaces that cooperate with corresponding indentations 36 and 42 on shaker flap 26 and spoon flap 22, respectively, to create ledges 38 and 44 (shown schematically for the spoon flap in FIG. 4 and for the shaker flap in FIG. 1) to receive a thumb, finger, etc. of a user for facilitating the opening of flaps 26 and 22 from a closed position. According to various alternative and exemplary embodiments, the indentations provided on opposite sides of the body portion may have a flat, planar surface (rather than a curved surface) or may have any one of a variety of different shapes, sizes, and contours. According to other various alternative and exemplary embodiments, the body portion may not include any indentations.

Body portion 100 further comprises projections 117 (e.g., extensions, protrusions, braces, legs, supports, etc.) that extend upward from the outer edge of recess 114 beyond end wall 120. Projections 117 are located on opposite sides of body portion 100 proximate each end of a central region 170 of end wall 120 and have the appearance of a continuous extension of side wall 110. Projections 117, which according to one exemplary embodiment are spaced apart from the substantially vertical surface of recess 114, are substantially rectangular in cross-section and follow the rounded shape of side wall 110. Each side of projection 117 is shaped (e.g., angled, sloped, etc.) to avoid interfering with skirts 40 and 34 on flaps 22 and 26 as flaps 22 and 26 are closed. A top surface 119 of each projection 117 provides a surface that may provide support for a portion of top portion 20. According to one exemplary embodiment illustrated in FIG. 7A, two members 118 (e.g., ribs, gussets, supports, fins, etc.) extend between each projection 117 and the corresponding vertical surface of recess 114. Members 118 are intended to support and rigidify projections 117. According to various alternative and exemplary embodiments, the members 118 may take one of a variety of different shapes, sizes, and configurations and may be provided in different numbers (e.g., only one member may extend between each projection 117 and recess 114, or more than two members may extend between each projection 117 and recess 114). According to other various alternative embodiments, the projections may be various sizes, thicknesses, shapes, locations, and orientations. According to other alternative embodiments, the projections may not be spaced apart from the substantially vertical surface of the recess. According to other various alternative embodiments, the projections may extend any length either upward from the recess and/or circumferentially around the periphery of the body portion. For example, the projections may extend a distance that makes the top surface of each projection substantially level with the end wall of the body portion.

Body portion 100 further comprises end wall 120 which is shown as being oriented perpendicular to a central axis of side wall 110. According to one exemplary embodiment, end wall 120 and side wall 110 are integrally formed as a single unitary body in a single mold by an injection molding operation to form body portion 100. According to various other exemplary and alternative embodiments, the end wall section and the side wall may be formed separately and may be coupled together in any suitable manner (e.g., snap-fit, etc.). According to another exemplary embodiment, side wall 110 may be slightly tapered (e.g., frustoconical, etc.) such that the diameter of side wall 110 near the top of body portion 100 is slightly smaller than the diameter of side wall 110 near the bottom of body portion 100. This slight taper (which may be as small as several thousandths) is intended to reduce the potential for interference with machinery that may be used to couple closure 10 to a receptacle.

End wall 120 comprises a plurality of shaker openings 160 (shown schematically as seven relatively small circular openings configured at least partially in an semi-circular pattern). Each of shaker openings 160 comprises a peripheral edge recess 162 on the underside of end wall 120 (shown schematically in FIGS. 4, 5, and 7D) that provides an area of reduced thickness (relative to other portions of end wall 120) surrounding openings 160. The area of reduced thickness is intended to provide a relatively thin, flexible region (e.g., flap, cantilever, etc.) around openings 160 to facilitate the sealing and retention features provided by the interfaces between openings 160 and skirts 60. According to various alternative and exemplary embodiments, the shaker openings may have any suitable shape, size, number and pattern (e.g., including that described in U.S. patent application Ser. No. 29/168,190, filed on Sep. 27, 2002, incorporated by reference herein) to suit the desired application and material to be dispensed from the container. For example, the end wall may include one shaker opening or it may include two or more shaker openings, and each shaker opening may have a shape and size that is suitable to the application in which the closure will be used. For example, one or more of the shaker openings may be circular, rectangular, tear-drop shaped, football-shaped, half moon-shaped, or one of a variety of other shapes.

End wall 120 also comprises spoon opening 156 (shown schematically as occupying approximately one-half of the area of end wall 120). Spoon opening 156 comprises a peripheral edge recess 158 on the underside of end wall 120 (shown schematically in FIGS. 5 and 7D) that provides an area of reduced thickness that is intended to provide a relatively flexible region (e.g., flap, cantilever, etc.) around opening 156, in a similar manner to edge recesses 162. According to one exemplary embodiment, the portion of end wall 120 surrounding and defining the curved portion of spoon opening 156 is relatively wide, which is intended to help reduce any ovality in body portion 100. According to various alternative and exemplary embodiments, the portion of end wall 120 that surrounds and defines spoon opening 156 has a width between approximately 0.100 inches and 0.250 inches. According to other alternative and exemplary embodiments, the portion of end wall 120 that surrounds and defines spoon opening 156 has a width between approximately 0.135 inches and 0.210 inches. According to other alternative and exemplary embodiments, the portion of end wall 120 that surrounds and defines spoon opening 156 has a width of approximately 0.200, 0.180, or 0.140 inches. According to other alternative and exemplary embodiments, the portion of end wall 120 that surrounds and defines spoon opening 156 may have a width greater than 0.250 inches or less than 0.100 inches. According to other various alternative and exemplary embodiments, the spoon opening may have any suitable shape and size, may comprise more than one opening, and may have any suitable pattern to suit the desired application and material to be dispensed from the container. For example, the spoon opening may be configured to receive a utensil other than a spoon, such as a measuring cup or a pair of tongs.

Figure 7D:
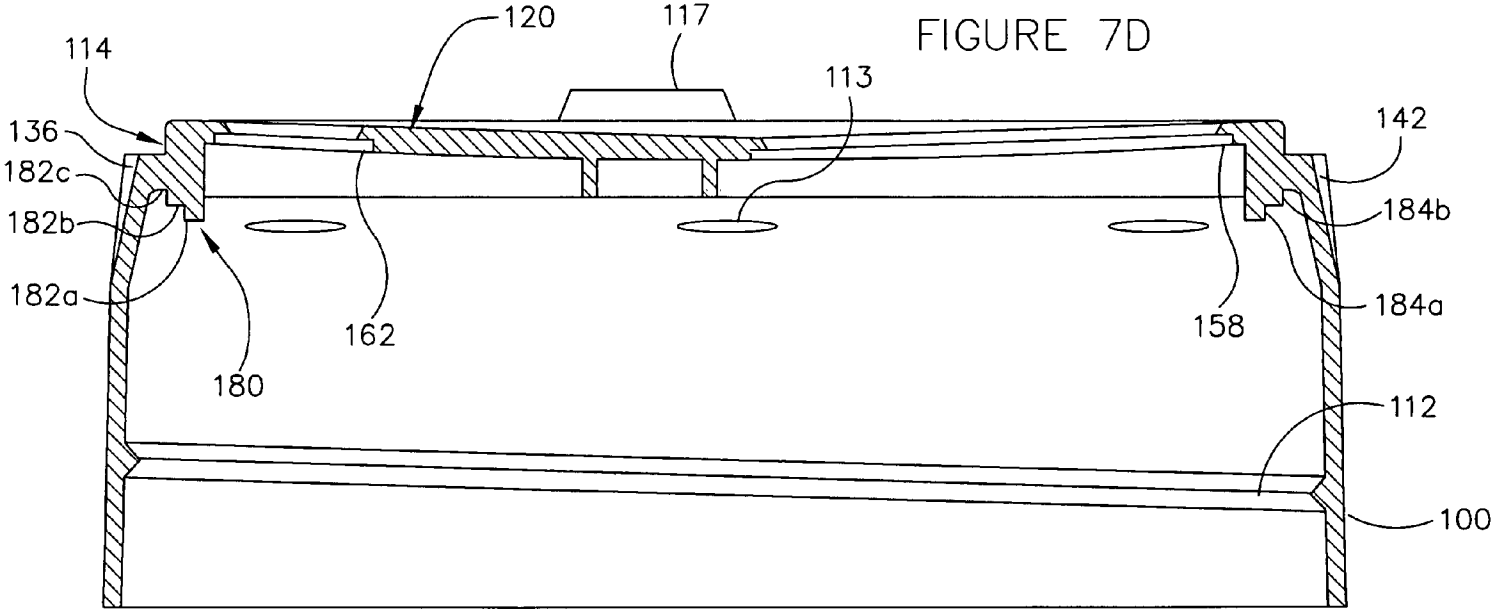
FIG. 7D is a schematic representation of a cross-sectional view of a body portion of a closure for a container taken along line 7D-7D of FIG. 7A.
Figure 7A:
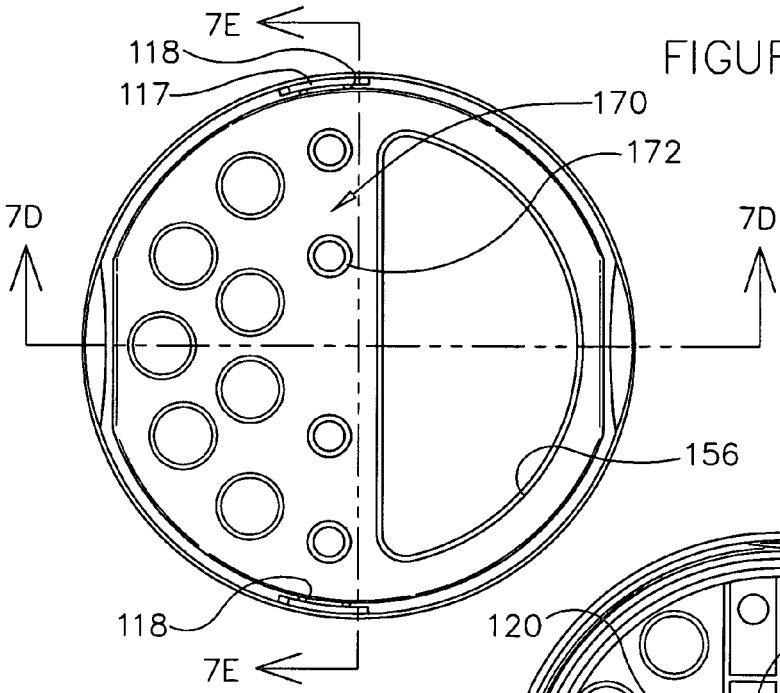
FIG. 7A is a schematic representation of a top view of a body portion of a closure for a container according to the embodiment of FIG. 1.
Figure 7B:
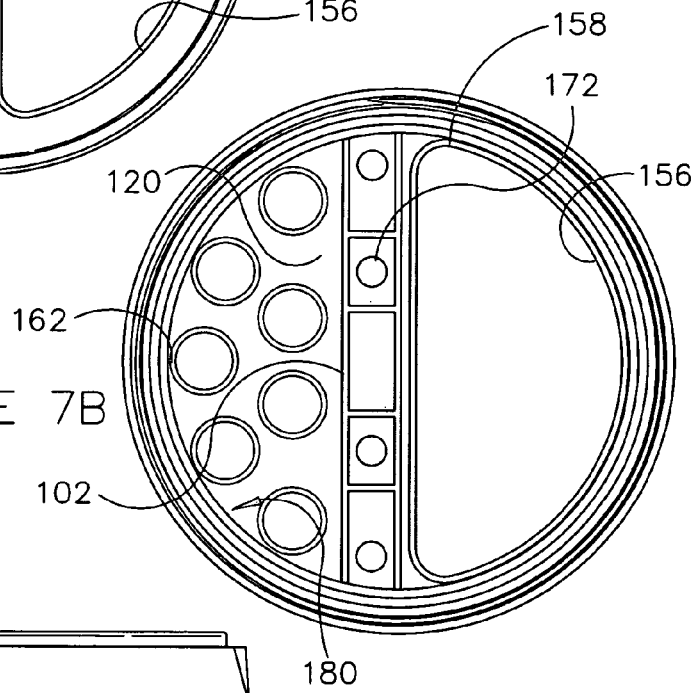
FIG. 7B is a schematic representation of a bottom view of a body portion of a closure for a container according to the embodiment of FIG. 1.
Figure 7C:
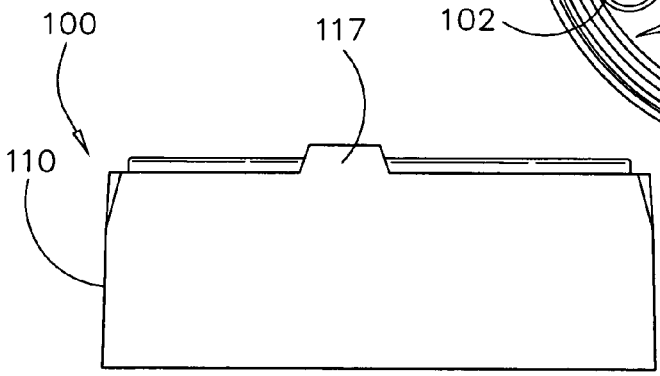
FIG. 7C is a schematic representation of a side view of a body portion of a closure for a container according to the embodiment of FIG. 1.

End wall 120 further comprises receiving structure (e.g., shown schematically as a plurality of coupling apertures 172, etc.—shown as four coupling apertures in FIGS. 3, 7A, and 7B) located in central region 170 of end wall 120 (shown schematically as approximately midway between shaker openings 160 and spoon opening 156). According to one exemplary embodiment, coupling apertures 172 are circular and have a diameter on the top side of end wall 120 that is greater than the diameter on the bottom side of end wall 120 to create a receiving profile (e.g., funnel-shape, cone, wedge, countersink, taper, etc.—see FIGS. 3 and 8) to receive the corresponding coupling structure provided on top portion 20. According to other exemplary and alternative embodiments, any number of coupling apertures may be provided in the end wall to correspond to the coupling structure of the top portion. According to other exemplary and alternative embodiments, the coupling apertures may take any one of a plurality of different shapes (e.g., square, triangular, oval, rectangular, trapezoidal, tear-drop shaped, football shaped, etc.). According to other alternative embodiments, the receiving structure may include pegs, projections, or other types of suitable coupling structures that are configured to cooperate with corresponding structure or structures provided on the top portion.

Referring to FIGS. 1 through 6D and 8, top portion 20 of closure 10 is shown according to an exemplary embodiment. Top portion 20 is circular and has a diameter corresponding approximately to the diameter of side wall 110 of body portion 100 such that when top portion 20 is coupled to body portion 100, top portion 20 and body portion 100 provide a smooth and uniform appearance. According to one exemplary embodiment, top portion 20 comprises central region 24, spoon flap 22, and shaker flap 26 (e.g., web, panel, bridge, strip, border, etc.).

According to one exemplary embodiment, central region 24 is diametrically offset relative to the periphery of top portion 20 to assist in increasing the rigidity of top portion 20. According to any exemplary embodiment, central region 24 provides a structure for joining shaker flap 26 and spoon flap 22. According to various exemplary embodiments, central region 24 may also provide an engaging structure (shown schematically in FIG. 5 as coupling structure 70) for engaging the receiving structure (e.g., coupling apertures 172) on body portion 100. According to one exemplary embodiment, the configuration of the engaging structure and the receiving structure is of a type shown in U.S. Pat. No. 5,219,100 (and products presently commercialized by Kraft Foods and marked with U.S. Pat. No. 5,219,100). According to various exemplary and alternative embodiments, the top portion may have any suitable structure that joins the shaker flap and the spoon flap and/or any suitable structure that facilitates the coupling of the top portion to the body portion (e.g., slide devices, fasteners, adhesives, etc.). According to an alternative embodiment, the top portion may include only one of the shaker flap and the spoon flap, such as when the closure is configured to be coupled to a relatively small receptacle.

According to an exemplary embodiment, spoon flap 22 has an interior edge 84 that is straight and that extends across top portion 20 in the form of a chord and defines a hinge 86 between spoon flap 22 and central region 24. Hinge 86 is shown as provided by a linear groove 85 (e.g., slot, cut away, recess, crevice, channel, etc.) or other suitable shape providing a line of reduced thickness about which spoon flap 22 can move or pivot relative to central region 24. Spoon flap 22 has an outer edge 87 that extends from opposite ends of interior edge 84 and has a circular profile that corresponds to an outer edge of side wall 110 and comprises a downwardly extending skirt 40. Downwardly extending skirt 40 is shown having a thickness approximately equal to the thickness of side wall 110 and a depth configured to fit within recess 114 on side wall 110 when spoon flap 22 is in a closed position. The depth and thickness of skirt 40 are intended to provide a degree of rigidity to spoon flap 22. According to another exemplary embodiment, the depth and thickness of the skirt may also provide an outer closure system for the spoon flap. Skirt 40 comprises indentation 42 (e.g., recess, etc.) that is formed by a curved (e.g., concave) lower segment of skirt 40 to provide a concave surface that cooperates with the corresponding indentation 142 on body portion 100. Indentation 42 creates a ledge 44 that may be used as a bearing surface for a user's thumb, finger, etc. for opening spoon flap 22. Spoon flap 22 may also be provided with indicia 48 (e.g., markings, formations, etc.—shown schematically as a "half-moon" corresponding to the spoon opening) that provides a general indication of the nature of the opening that is located beneath the flap.

Referring now to FIGS. 1 through 3, 5 through 6D and 8, shaker flap 26 has an interior edge 80 that is straight and that extends across top portion 20 in the form of a chord and defines a hinge 82 between shaker flap 26 and central region 24. According to one exemplary embodiment, hinge 82 is parallel to hinge 86 on spoon flap 22 and is substantially similar to hinge 86. Shaker flap 26 has an outer edge 89 that extends from opposite ends of the interior edge 80 and has a circular profile that corresponds to an outer edge of side wall 110. Shaker flap 26 also comprises a downwardly extending skirt 34 having an indentation 36 (e.g., recess, etc.) that is formed by a curved lower segment of skirt 34 to provide a concave surface that cooperates with the corresponding indentation 136 on body portion 100 to facilitate opening of shaker flap 26 by a user. Downwardly extending skirt 34 and indentation 36 are substantially similar to skirt 40 and indentation 42. Shaker flap 26 may also be provided with indicia 50 (e.g., markings, formations, etc.—shown schematically as seven circles corresponding to the size and position of the plurality of shaker openings) that provide a general indication of the nature of the opening(s) that are located beneath shaker flap 26.

According to various alternative and exemplary embodiments, the indentations provided on the shaker flap and the spooning flap may have any one of a variety of different shapes, sizes, and contours. For example, the indentation on the shaker flap and/or the spooning flap may be formed by substantially straight or planar segments of the skirts. According to other various alternative and exemplary embodiments, the shaker flap and/or the spooning flap may not include any indentations. According to other various exemplary and alternative embodiments, the heights of the shaker flap and the spoon flap (e.g., the heights of skirts 34 and 40, respectively) are between approximately 10 and 40 percent of the total height of the closure (e.g., the distance between the bottom of side wall 110 and the top surface of top portion 20). According to other various exemplary and alternative embodiments, the heights of the shaker flap and the spoon flap are between approximately 15 and 35 percent of the total height of the closure. According to other various exemplary and alternative embodiments, the heights of the shaker flap and the spoon flap are either between approximately 18 and 23 percent of the total height of the closure or between approximately 25 and 32 percent of the total height of the closure. According to other various alternative and exemplary embodiments, the heights of the shaker flap and the spoon flap may be any percentage of the height of the closure depending on the particular application for which the closure will be used.

Referring now to FIGS. 3, 5, 6B through 6D, 7A through 7B, and 8, the engaging structure for body portion 100 and top portion 20 is shown according to an exemplary embodiment. According to various exemplary and alternative embodiments, the engaging structure is configured to permit body portion 100 and top portion 20 to be coupled to each other to provide a closure for use with a receptacle. Top portion 20 comprises engaging structure (shown schematically as coupling structure 70) extending from an underside of central region 24. According to one exemplary embodiment, coupling structure 70 comprises two ribs 71 (e.g., bars, beams, supports, etc.) and four projections 72 (e.g., legs, tubes, plugs, etc.), each shown having a cylindrical base 73 and a lower, outer ridge 74 (e.g., rib, collar, barb, etc.). End wall 120 of body portion 100 has a central region or section 170 that comprises receiving structure (shown schematically as coupling apertures 172) that correspond in location to projections 72. Projections 72 are configured to extend into apertures 172 such that ridges 74 engage the lower surface of end wall 120 or lower corner of apertures 172 (e.g., as shown schematically in FIG. 8) to retain top portion 20 in a coupled relationship with body portion 100. Projections 72 and coupling apertures 172 are shown located along a chord that is offset from a diameter of body portion 100 and top portion 20. The offset is intended to permit top portion 20 to be coupled to body portion 100 in only a single orientation where spooning flap 22 is positioned over spooning opening 156 and shaker flap 26 is positioned over shaker openings 160.

According to various exemplary and alternative embodiments, the projections may take any one of a plurality of different shapes (e.g., square, triangular, oval, rectangular, trapezoidal, tear-drop shaped, football shaped, etc.) and be provided in different numbers to correspond to the receiving structure provided within the end wall. According to other various alternative and exemplary embodiments, the extensions may be provided on any of the projections (e.g., the inner projections, one inner and one outer projection, etc.) and may be provided on one, three, or any number of the projections. According to still other alternative and exemplary embodiments, the extensions may be the same size and shape as the base of the projections so as to effectively elongate the base, or the extensions may take any one of a variety of different shapes and sizes.

According to one exemplary embodiment, the top portion and the body portion may be formed in separate molds and then joined to form a closure by coupling the engaging structure with the receiving structure. According to various exemplary and alternative embodiments, the engaging structure and the receiving structure provided in the end wall and top portion may comprise any number of projection/aperture pairs. According to other various exemplary and alternative embodiments, the projections may include any suitable structure (e.g., snap fit, friction fit, barb, flange, clip, radial extensions, etc.) for retaining the top portion in a coupled relationship with the body portion. According to other various alternative and exemplary embodiments, the top portion and the body portion may be integrally formed as a single unitary body and may not include any engaging structure or receiving structure.

Figure 4:
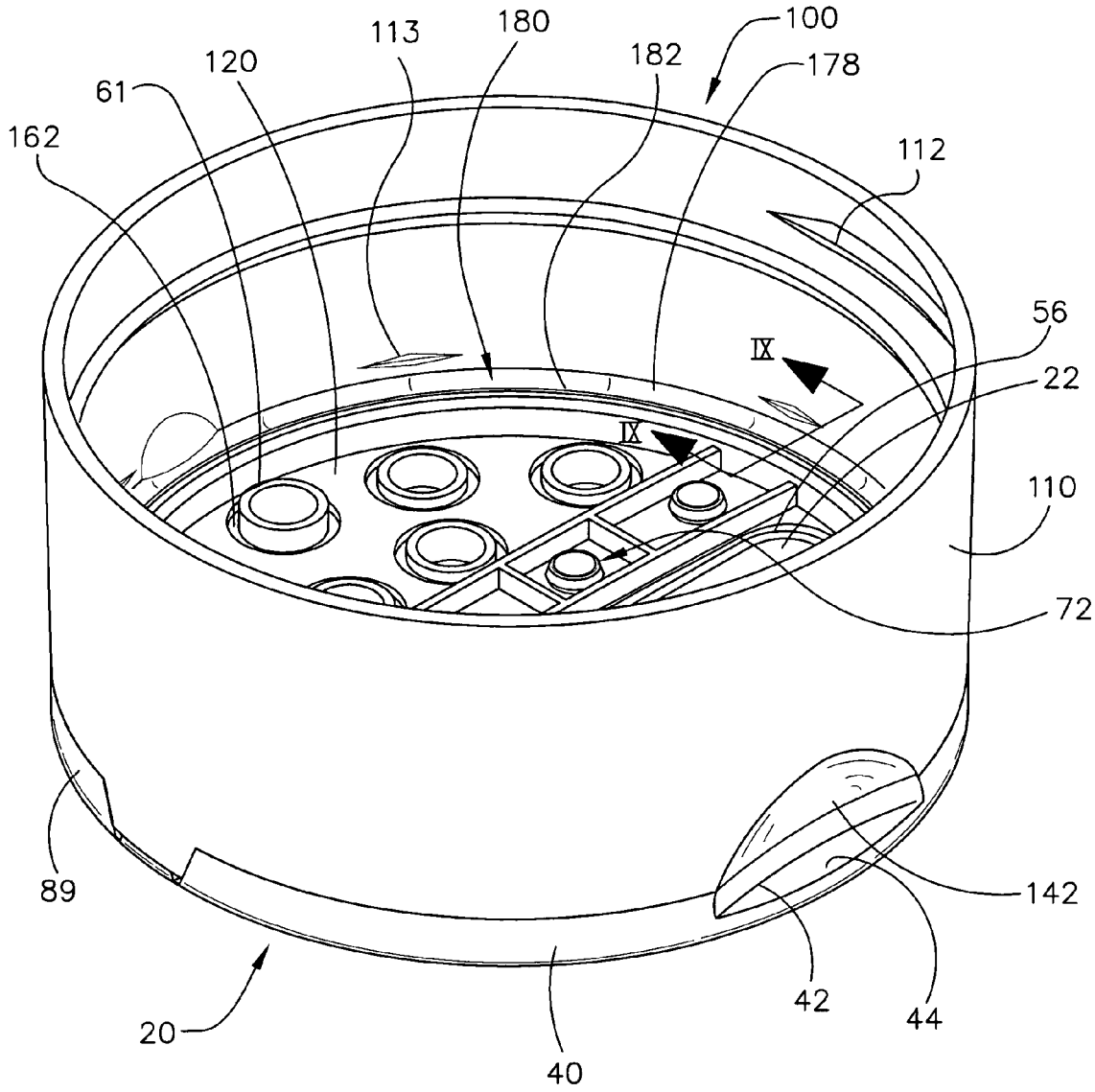
FIG. 4 is a schematic representation of a bottom perspective view of a spoon side of a closure for a container according to the embodiment of FIG. 1.
Figure 5:
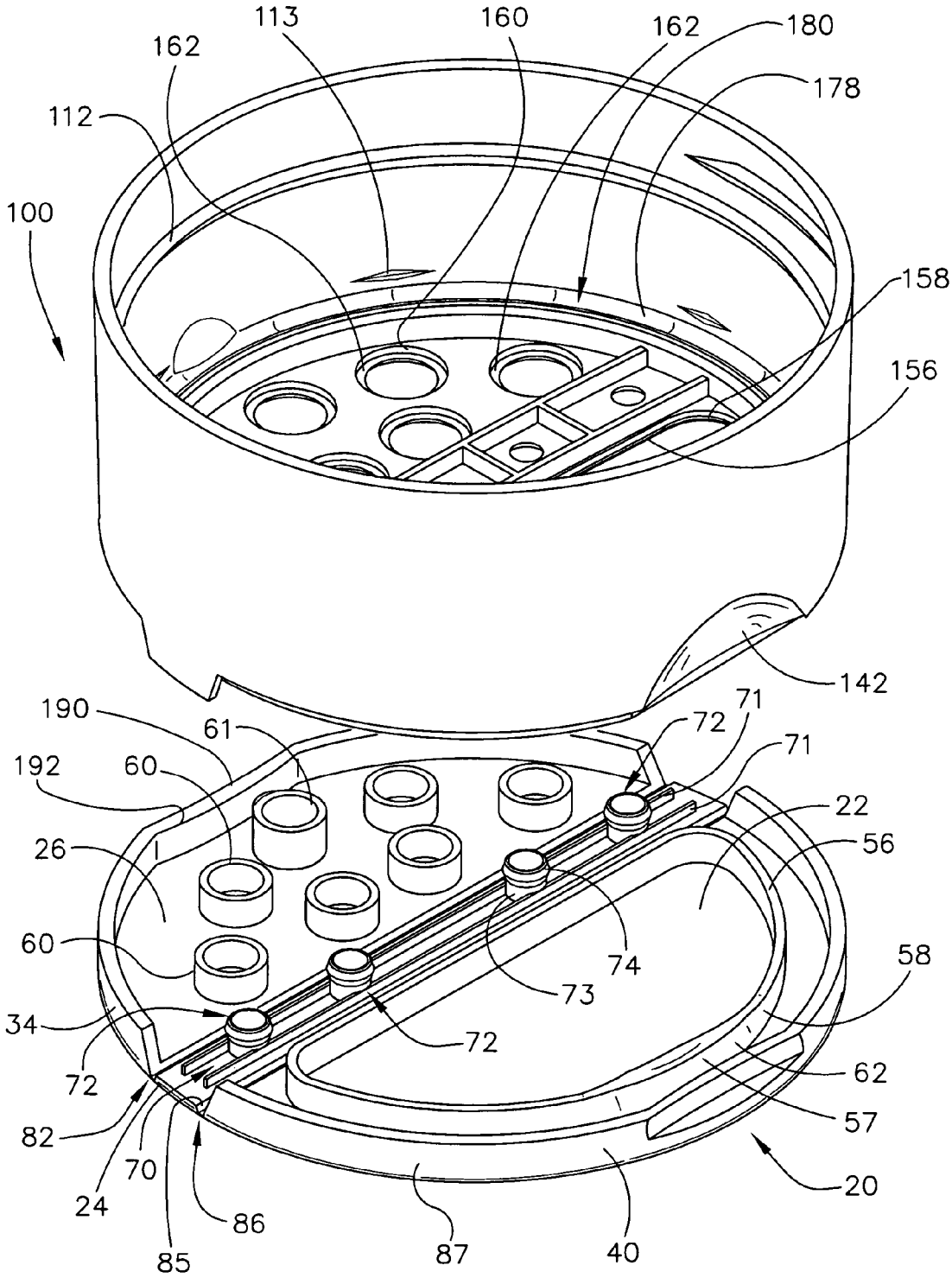
FIG. 5 is a schematic representation of a bottom exploded perspective view of a spoon side of a closure for a container having a body portion and a top portion according to the embodiment of FIG. 1.
Figure 6A:
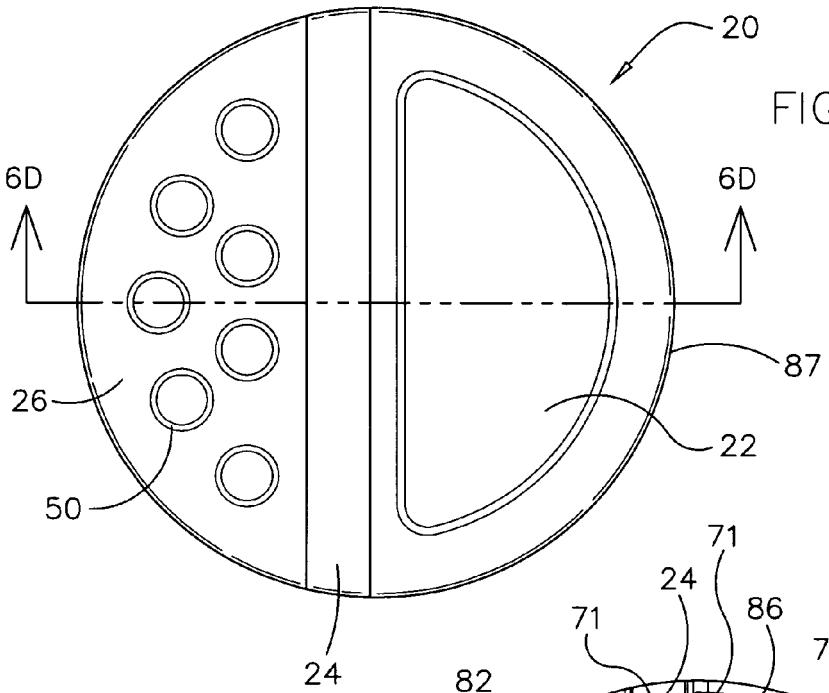
FIG. 6A is a schematic representation of a top view of a top portion of a closure for a container according to the embodiment of FIG. 1.
Figure 6B:
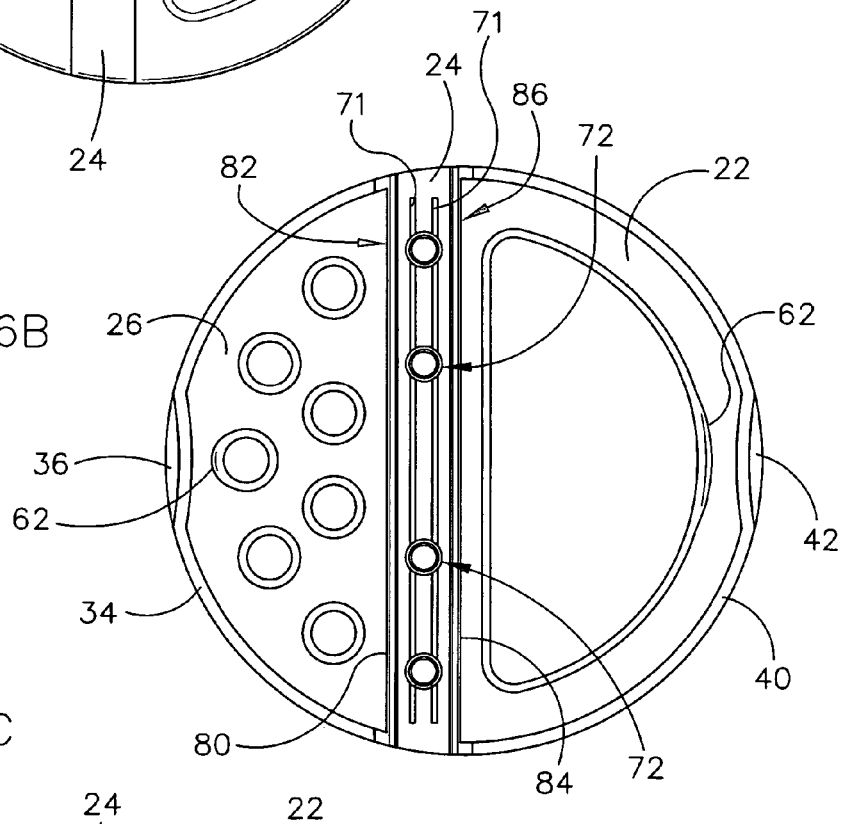
FIG. 6B is a schematic representation of a bottom view of a top portion of a closure for a container according to the embodiment of FIG. 1.
Figure 6C:
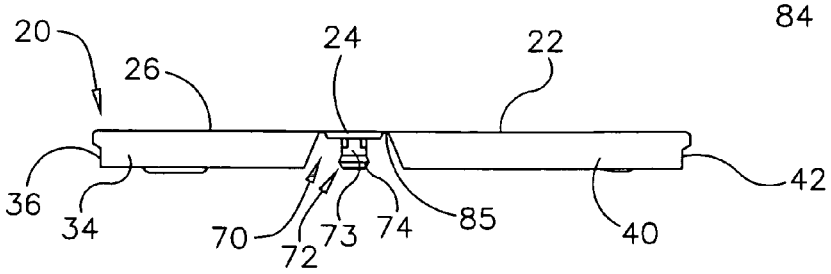
FIG. 6C is a schematic representation of a side view of a top portion of a closure for a container according to the embodiment of FIG. 1.
Figure 6D:
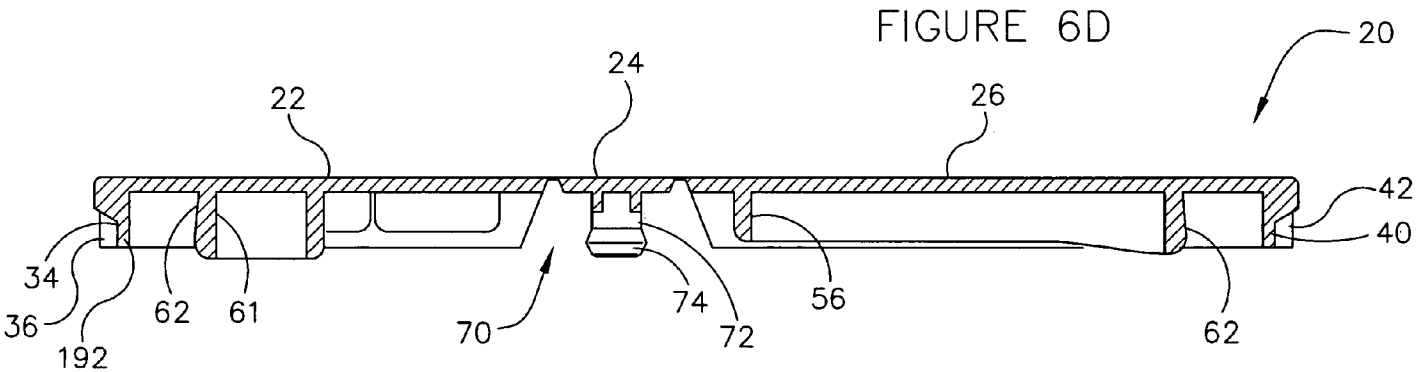
FIG. 6D is a schematic representation of a cross-sectional view of a top portion of a closure for a container taken along line 6D-6D of FIG. 6A.

Referring to FIGS. 4 and 5, a spoon flap closure system (e.g., inner closure system) is shown according to an exemplary embodiment. Spoon flap 22 comprises a projection 56 (e.g., clean-out ring, etc.) extending perpendicularly downward from an underside of spoon flap 22 and having an outline corresponding to spoon opening 156 (e.g., having a rounded outer edge 58). According to the illustrated embodiment, projection 56 has a rectangular cross-section and is positioned to engage (e.g., by friction) all, or a portion, of spoon opening 156 when spoon flap 22 is moved to a closed position to releasably retain spoon flap 22 in the closed position. According to an alternative embodiment, the lower, outside edge (or a portion of the edge) of the projection may be relieved (e.g., radiused, angled, sloped, chamfered, beveled, etc.) to facilitate entry of the projection in the opening. The extension of projection 56 into spoon opening 156 tends to reduce the likelihood of "sifting" or other leakage of material in the container out from beneath spoon flap 22 when spoon flap 22 is in the closed position. According to one exemplary embodiment, the length of projection 56 is sufficient to allow the end of projection 56 to at least extend into spoon opening 156. According to various alternative and exemplary embodiments, the length of the projection may be sufficient to allow the projection to extend completely through the spoon opening or only a portion of the way through the spoon opening. According to one exemplary embodiment illustrated in FIGS. 5, 6D, and 8, projection 56 comprises a central outer portion 57 that is longer than the rest of projection 56. The added length of projection 56 at central outer portion 57 is intended to allow central outer portion 57 to engage the corresponding spoon opening 156 prior to the engagement of the rest of projection 56 when spoon flap 22 is being moved into the closed position. As a result, the angle of projection 56 (with respect to the central axis of side wall 110) as central outer portion 57 comes into contact with the corresponding spoon opening 156 when spoon flap 22 is being closed is greater than the angle of the rest of projection 56 when the rest of projection 56 comes into contact with spoon opening 156. The greater angle of contact is intended to create a greater degree of friction with the corresponding spoon opening 156. Adjusting the length of the central outer portion 57 is intended to alter the amount of force required to close (and open) spoon flap 22.

Referring still to FIGS. 4 and 5, a shaker flap closure system (e.g., inner closure system) is shown according to an exemplary embodiment. Shaker flap 26 has a plurality of projections 60 (e.g., clean-out rings, etc.) extending perpendicularly downward from an underside of shaker flap 26, corresponding to shaker openings 160. According to the illustrated embodiment, projections 60 have a rectangular cross-section and are positioned to engage (e.g., by friction) the corresponding shaker opening 160 when shaker flap 26 is moved to a closed position to releasably retain shaker flap 26 in the closed position. According to an alternative embodiment, the lower, outside edge (or a portion of the edge) of one or more of the projections may be relieved (e.g., radiused, angled, sloped, chamfered, beveled, etc.) to facilitate entry of the projection in the openings. The extension of projections 60 into shaker openings 160 tends to reduce the likelihood of "sifting" or other leakage of material in the receptacle out from beneath shaker flap 26 when shaker flap 26 is in the closed position. According to one exemplary embodiment, the length of each projection 60 is sufficient to allow the end of each projection 60 to at least extend into the corresponding shaker opening 160. According to various alternative and exemplary embodiments, the length of each projection may be sufficient to allow the projection to extend completely through the corresponding shaker opening or only a portion of the way through the corresponding shaker opening. According to another exemplary embodiment, at least one of the projections, shown as projection 61, is longer than the other projections (or, alternatively, includes a portion that extends beyond the length of the other projections 60). The added length of projection 61 is intended to allow projection 61 to engage the corresponding shaker opening 160 prior to the engagement of other shaker openings 160 by the other projections 60 when shaker flap 26 is being moved into the closed position. As a result, the angle of projection 61 (with respect to the central axis of side wall 110) as projection 61 comes into contact with the corresponding shaker opening 160 when shaker flap 26 is being closed is greater than the angle of projections 60 when projections 60 come into contact with the corresponding shaker openings 160. The greater angle of contact is intended to create a greater degree of friction with the corresponding shaker opening 160. By adjusting the length of the projection and/or the number of projections having such an adjusted length, the amount of force required to fully close (and open) shaker flap 26 can be adjusted or modified as desired.

According to various alternative and exemplary embodiments, the projections (or a portion of the projections) on the underside of the spoon flap and shaker flap may extend at an angle other than approximately 90 degrees from the underside of the flaps, and/or may include one or more perpendicular stiffening ribs or T-guides (e.g., such as those shown in U.S. Pat. No. 6,691,901 titled Closure for a Container issued on Feb. 17, 2004 and incorporated by reference herein) that are configured to engage the edge of the spoon or shaker openings and guide the projections into the openings with a wedging interaction. According to various alternative embodiments, the projections may extend only partially around the perimeter of the spoon and shaker openings. According to other alternative embodiments, the projections may be replaced with recesses that are formed into the top side of the spoon flap and shaker flap, that extend downward from the bottom side of the spoon flap and shaker flap, and that are configured to extend into and/or engage the spoon and shaker openings. According to other alternative embodiments, the projections may have a rectangular cross-section with a relieved (e.g., chamfered, tapered, beveled, sloping, radiused, etc.) lower outer edge or the projections may have a cross-section that is one of a variety of other shapes (e.g., football-shaped, trapezoidal, triangular, etc.). According to other alternative embodiments, the projections may have different lengths. According to other various alternative and exemplary embodiments, one or more of the projections may include radially outwardly extending projections (e.g., barbs, fingers, flanges, lips, extensions, etc.) that are configured to engage the under side of end wall 120 to retain the flap in a closed position. According to other various alternative and exemplary embodiments, one or more of the projections may include a radially outward extending portion 62 (e.g., a barb, a projection, an extension, a flange, a lip, a tab, undercut, etc.) that forms an angled surface on the projection such that movement of the flap from the open position to the closed position brings the outwardly extending portion into wedging interaction with an inner edge of the opening, which serves to retain the flap in the closed position. According to one exemplary embodiment, the angled surface of outwardly extending portion 62 may extend downward at an angle relative to a line perpendicular to the bottom surface of the flap so that the surface extends farther away from the projection in the radial direction as it extends away from flap. The angle at which the surface extends downward may range from between approximately 15 degrees and approximately 1 degree, or more preferably between approximately 10 degrees and approximately 3 degrees, or more preferably between approximately 8 degrees and approximately 5 degrees, or more preferably, may extend at an angle of approximately 5 degrees. According to one exemplary embodiment, outwardly extending portion 62 is only provided on the portion of the circumference or periphery of the projection that is on the opposite side of the projection as the hinge of the flap. According to other alternative and exemplary embodiments, each outwardly extending portion may extend around any portion of the circumference or periphery of the projection or it may extend around the entire circumference or periphery of the projection. According to other alternative and exemplary embodiments, each projection may include only a single outwardly extending portion or it may include two or more outwardly extending portions. According to still other alternative and exemplary embodiments, the outwardly extending portion may take other configurations that engage the material around the opening to releasably retain the flap in a closed or substantially closed position. For example, the outwardly extending portion may be a barb, a hook, a flange, a finger, or other type of projection or extension that otherwise interferes with the opening of the flap.

According to various exemplary and alternative embodiments, the inner closure system (e.g., the shaker flap closure system and/or the spoon flap closure system) provide structure that tends to maintain the flaps in a closed position after the flaps are moved to a closed position and to minimize the tendency for material in the container to "sift" or otherwise leak out from the openings when the flaps are closed. According to various alternative embodiments, the inner closure system may cooperate with an outer closure system such as that described in International Application Serial No. PCT/US2005/013562, filed on Sep. 3, 2005 and entitled "Closure for a Container" (which is hereby incorporated by reference herein). The outer closure system may provide structure that tends to "supplement" or otherwise assist the inner closure system and help retain the flaps in a closed position when the closure is subject to distortion (e.g., during container filling and capping operations in which the closure may be subjected to varying degrees of torque or other forces during installation of the closures on the receptacles, etc.). According to other alternative embodiments, the inner closure system or the outer closure system may provide the only structure that tends to maintain the flaps in a closed position or the closure may utilize one closure system for the shaker flap and the other closure system for the spoon flap.

Referring to FIGS. 4, 5, 7B, 7D, 7E, and 8, a sealing structure for a closure for a container is shown according to one exemplary embodiment. Sealing structure 180 (e.g., ring, sealing ring, stepped sealing ring, etc.) is configured with a plurality of sealing surfaces 182*a*, 182*b*, and 182*c* (e.g., as shown in U.S. Pat. No. 6,460,718 which is hereby incorporated by reference herein). According to one exemplary embodiment, sealing structure 180 extends from the lower surface of end wall 120 and is spaced apart from the inner circumference of side wall 110. Sealing surfaces 182*a*, 182*b*, and 182*c* are arranged in a "step-wise" pattern of coaxial surfaces such that the distance from end wall 120 increases as the diameter of the sealing surface decreases. According to various alternative and exemplary embodiments, the width of the sealing surfaces in the radial direction may be approximately equal to the thickness of the portion of the receptacle that will contact the sealing surfaces (e.g., the rim or mouth of the receptacle), but the width of the sealing surfaces may be greater or less than the thickness of the receptacle rim. Between each of sealing surfaces 182*a*, 182*b*, and 182*c* is a wall or surface that is perpendicular to the sealing surfaces 182*a*, 182*b*, and 182*c*. Wall 184*a* extends between sealing surfaces 182*a* and 182*b* from the outer periphery of sealing surface 182*a* to the inner periphery of sealing surface 182*b*. Similarly, wall 184*b* extends between sealing surfaces 182*b* and 182*c* from the outer periphery of sealing surface 182*b* to the inner periphery of sealing surface 182*c*. Such step-wise sealing surfaces 182*a*, 182*b*, and 182*c* are intended to urge a container mouth that has an out-of-round condition (e.g., oval, etc.) into a generally round condition for sealing against one of the plurality of sealing surfaces 182*a*, 182*b*, and 182*c*. Such step-wise sealing surfaces 182*a*, 182*b*, and 182*c* may also accommodate variations in the diameters of the mouths of receptacles (e.g., due to variations in tolerances, different container manufacturers or equipment, etc.). According to various alternative embodiments, the sealing surfaces may be configured so that the distance from the end wall may increase as the diameter of the sealing surfaces increases. According to other alternative embodiments, the sealing surfaces may be flat and parallel to the end wall, or they may have a convex or concave curvature, or they may have any combination of these or other suitable configurations and may be provided at any angle with respect to the end wall. According to other alternative embodiments, the transition from a wall to a sealing surface may be gradual (e.g., radiused, beveled, tapered, etc.) or it may be a substantially "sharp" corner. According to other alternative embodiments, the walls may be oriented at any angle with respect to the sealing surfaces. According to other various alternative and exemplary embodiments, the sealing structure may include one, two, four, or any number of sealing surfaces.

According to another alternative embodiment, the sealing structure may comprise a single downwardly extending projection (e.g., sealing ring, ridge, rim, etc.—not shown) having a shape and location that corresponds with a mouth of a receptacle such that the sealing ring is positioned to abut the mouth when the closure and receptacle are coupled together. According to various alternative and exemplary embodiments, the sealing ring may have a circular outline that is coaxial with the side wall, may extend from an interior underside of the recess in the upper perimeter of the side wall, and/or may have a lower edge with a semicircular cross-sectional shape configured to compress a conventional sealing sheet (e.g., liner, etc.) between the sealing ring and the mouth of a receptacle to create a seal. According to other alternative embodiments, the sealing ring may have any suitable cross-sectional shape (e.g., flat, pointed, tapered, etc.) and a width sufficient to provide an effective seal against the mouth of the receptacle.

Figure 9:
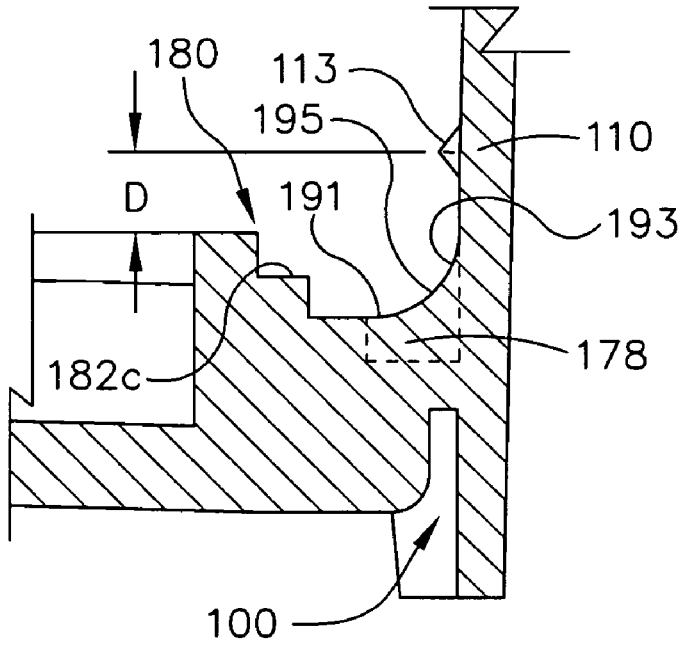
FIG. 9 is a schematic representation of a partial cross-sectional view of the body portion of the closure for a container taken along line IX-IX of FIG. 4.
Figure 10:
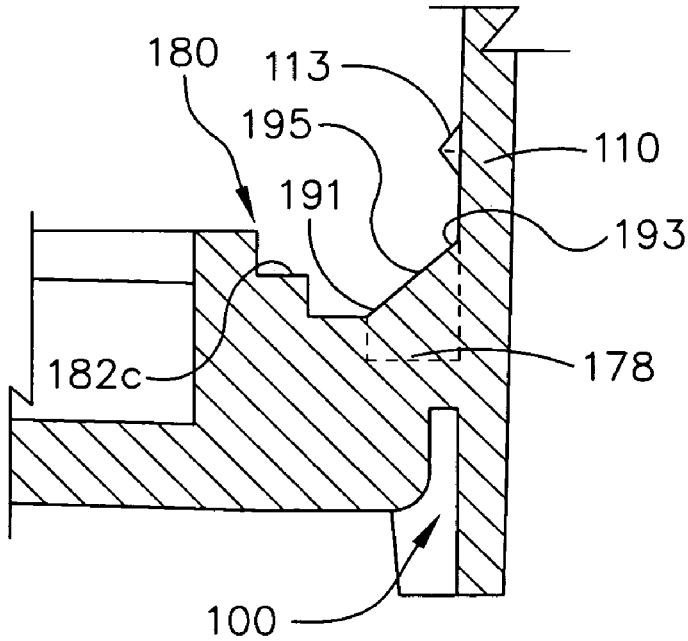
FIG. 10 is a schematic representation of a partial cross-sectional view of a body portion of a closure for a container according to another embodiment.

Referring to FIGS. 4, 9, and 10, a transition region for a closure for a container is shown according to various exemplary and alternative embodiments. Transition region 178 is a generally annular fillet that is intended to form a transition between end wall 120 and side wall 110 and to rigidify the closure to minimize the extent to which end wall 120 of the closure may be forced into a curved or domed shape or otherwise deflect relative to side wall 110 when the closure is coupled to the receptacle. According to one exemplary embodiment, transition region 178 extends downward (upward as illustrated in FIGS. 4, 9, and 10) from end wall 120 between sealing structure 180 and side wall 110 and includes a side 191 proximate sealing structure 180, a side 193 proximate side wall 110, and a bottom surface 195 that is exposed or visible from the underside of closure 10. The length of first side 191 (e.g., the distance first side 191 extends downward from end wall 120) is equal to the length of the radially outermost portion of sealing structure 180 (e.g., sealing surface 182*c*), and the length of second side 193 is greater than the length of first side 191. According to one exemplary embodiment, side 193 has a length that is no greater than 0.125 inches longer than the length of side 191 and that does not extend far enough downward to intersect projection 113. According to other alternative and exemplary embodiments, the side 193 may be more than 0.125 inches longer than side 191, or may have the same length as side 191, or may extend downwardly far enough to intersect, or extend beyond, projection 113.

Bottom surface 195 (e.g., exposed surface, visible surface, etc.) of transition region 178 extends between side 191 and side 193 and may have one of a variety of different configurations. For example, according to one exemplary embodiment illustrated in FIGS. 4 and 9, bottom surface 195 is curved or radiused such that bottom surface 195 is parallel to, and even with, the radially outermost portion of sealing structure 180 (e.g., sealing surface 182*c*) at side 191 and gradually curves approximately 90 degrees so that bottom surface 195 is parallel to sidewall 110 at side 193. According to another exemplary embodiment illustrated in FIG. 10, bottom surface 195*a* is planar, extending in a substantially straight line between the lower end of side 191 and the lower end of side 193. According to another exemplary embodiment, the bottom surface may be stepped. According to still another exemplary embodiment, the bottom surface may be curved or radiused such that the bottom surface is perpendicular to the outermost portion of sealing structure 180 (e.g., sealing surface 182*c*) at side 191 and gradually curves approximately 90 degrees so that the bottom surface is perpendicular to sidewall 110 at side 193. According to other various alternative and exemplary embodiments, the bottom surface of the transition region may take a multitude of other configurations, such as a combination of the configurations illustrated in FIGS. 4, 9, and 10 or a plurality of other configurations having various straight and/or curved segments. According to other various alternative and exemplary embodiments, the transition region may extend continuously around the sealing structure or it may be provided as discrete segments. According to still other various alternative and exemplary embodiments, the cross-section of the transition region may vary as it extends around the inside of the closure. According to other various alternative and exemplary embodiments, the length of the side of the transition region proximate the sealing structure may be greater or less than the length of the outermost portion of the sealing structure (e.g., sealing surface 182*c*). According to other alternative embodiments, the bottom surface may extend between the end wall (as opposed to the sealing structure) and the sidewall so that the transition region provides a radiused, beveled, tapered, etc. transition or fillet between the end wall and the side wall. According to still other alternative embodiments, the bottom surface may extend between other structures of the closure generally proximate the juncture of the end wall and the side wall.

Figure 11A:
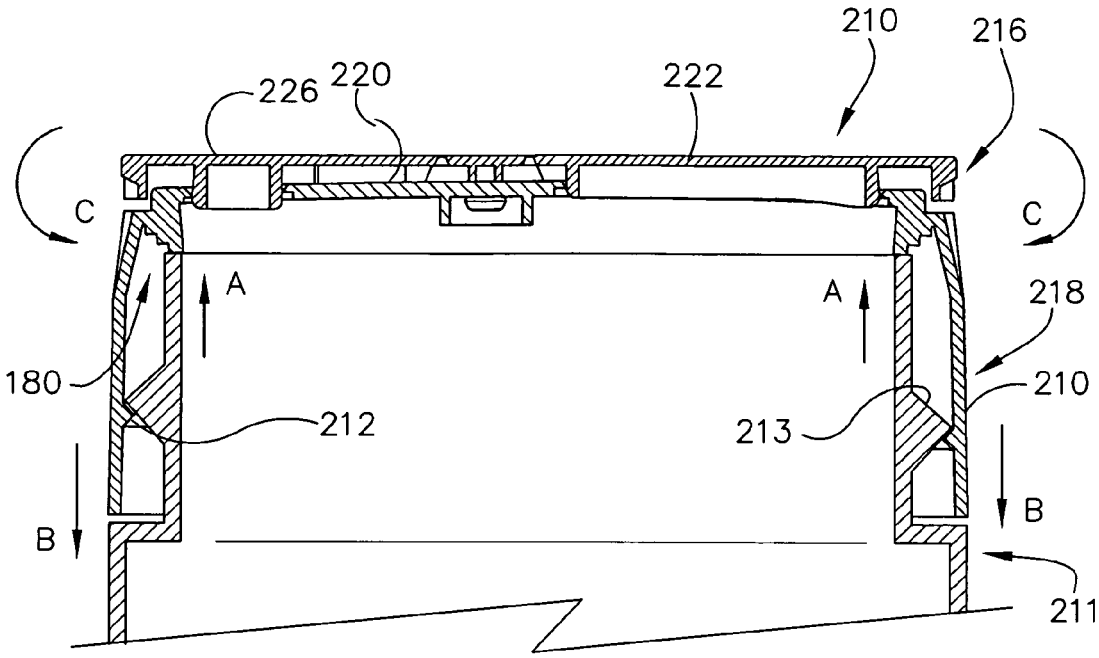
FIG. 11A is a schematic representation of a cross-sectional view of a closure for a container not having the transition region coupled to a receptacle.

Referring now to FIG. 11A, a closure 210 that does not include a transition region 178 is shown (schematically) coupled to a receptacle 211 and in a form that closure 210 is believed to assume in certain situations. As shown, the coupling of closure 210 to receptacle 211 applies forces to closure 210 that cause end wall 220 of closure 210 to be deflected into a curved (e.g., concave) or domed state. When closure 210 is being coupled to receptacle 211, the mouth of receptacle 211 will extend into closure 210 until it contacts sealing structure 180. Once the mouth of receptacle 211 contacts sealing structure 180, additional tightening of closure 210 onto receptacle 211 causes the mouth of receptacle 211 to apply an upward force indicated by arrows A to sealing structure 180 and causes threads 213 of receptacle 211 to apply a downward force indicated by arrows B to threads 212 and side wall 210 of closure 210. Because the downward force B is applied to side wall 210 and the upward force A is applied to sealing structure 180, which is located radially inwardly of side wall 210, a moment indicated by arrows C is believed to be applied to end wall 220 and side wall 210 and is believed to act at or near the juncture of end wall 220 and side wall 210. If the magnitude of moment C is large enough, moment C will cause end wall 220 to assume the domed condition. When end wall 220 assumes the domed condition, the portion of top portion 216 that is coupled to end wall 220 is raised along with end wall 220. Because top portion 216 is not otherwise coupled to body portion 210, the domed condition of end wall 220 has the effect of raising the outer edge of top portion 216 above the outer edge of end wall 220 (which is not raised to the same extent as the center of end wall 220). When this occurs, the placement of the components of top portion 216 (e.g., projections 260 and 256 extending downward from shaker flap 226 and spoon flap 222, respectively) relative to the placement of the corresponding components of body portion 218 (e.g., the edges of shaker openings 262 and spooning opening 258) are altered. In some situations, this is believed to reduce or totally eliminate the effectiveness of the inner closure system or other closure systems that may be provided.

Figure 11B:
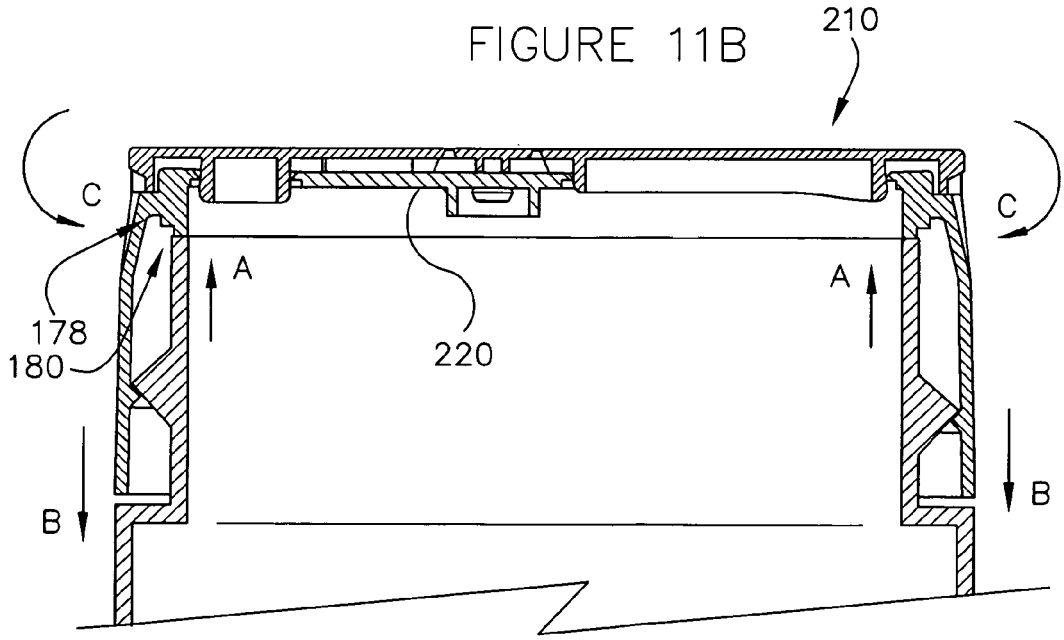
FIG. 11B is a schematic representation of a cross-section view of the closure for a container of FIG. 1 coupled to a receptacle.

FIG. 11B illustrates the same situation illustrated in FIG. 11A, except that closure 210 includes a transition region 178. As shown in FIG. 11B, closure 210 is less affected by the forces and moments applied to it by receptacle 211. The incorporation of transition region 178 into closure 210 is believed to rigidify closure 210 in a way that makes closure 210 capable of withstanding greater forces and moments before deforming to an extent that significantly interferes with the effective operation of the inner closure system or other closure systems of the closure.

Referring to FIGS. 4, 5, 7D, 7E, and 8, projections for a closure for a container are shown according to an exemplary embodiment. Projections 113 extend inwardly and intermittently from the interior side of side wall 110 around the inner circumference of side wall 110. Projections 113 are located on side wall 110 a sufficient distance from the underside of end wall 120 to allow projections 113 to cooperate with the lowest surface of the sealing structure to permit a sealing sheet (e.g., liner, etc.) to be placed and retained between projections 113 and the sealing structure (such as during assembly or manufacturing of the closure). According to various exemplary and alternative embodiments, the projections may vary in number, size, shape, and location. According to other alternative embodiments, the projections may be one continuous projection that extends around the entire inner circumference of the side wall.

Figure 7E:
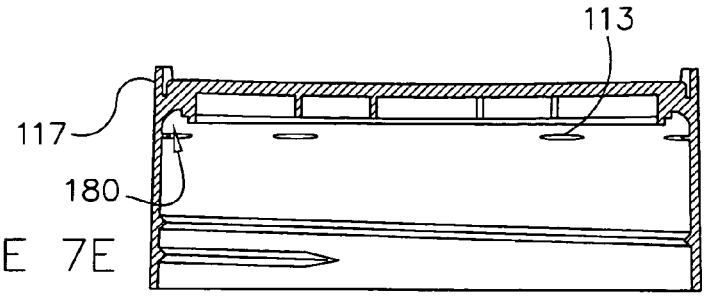
FIG. 7E is a schematic representation of a cross-sectional view of a body portion of a closure for a container taken along line 7E-7E of FIG. 7A.
Figure 8:
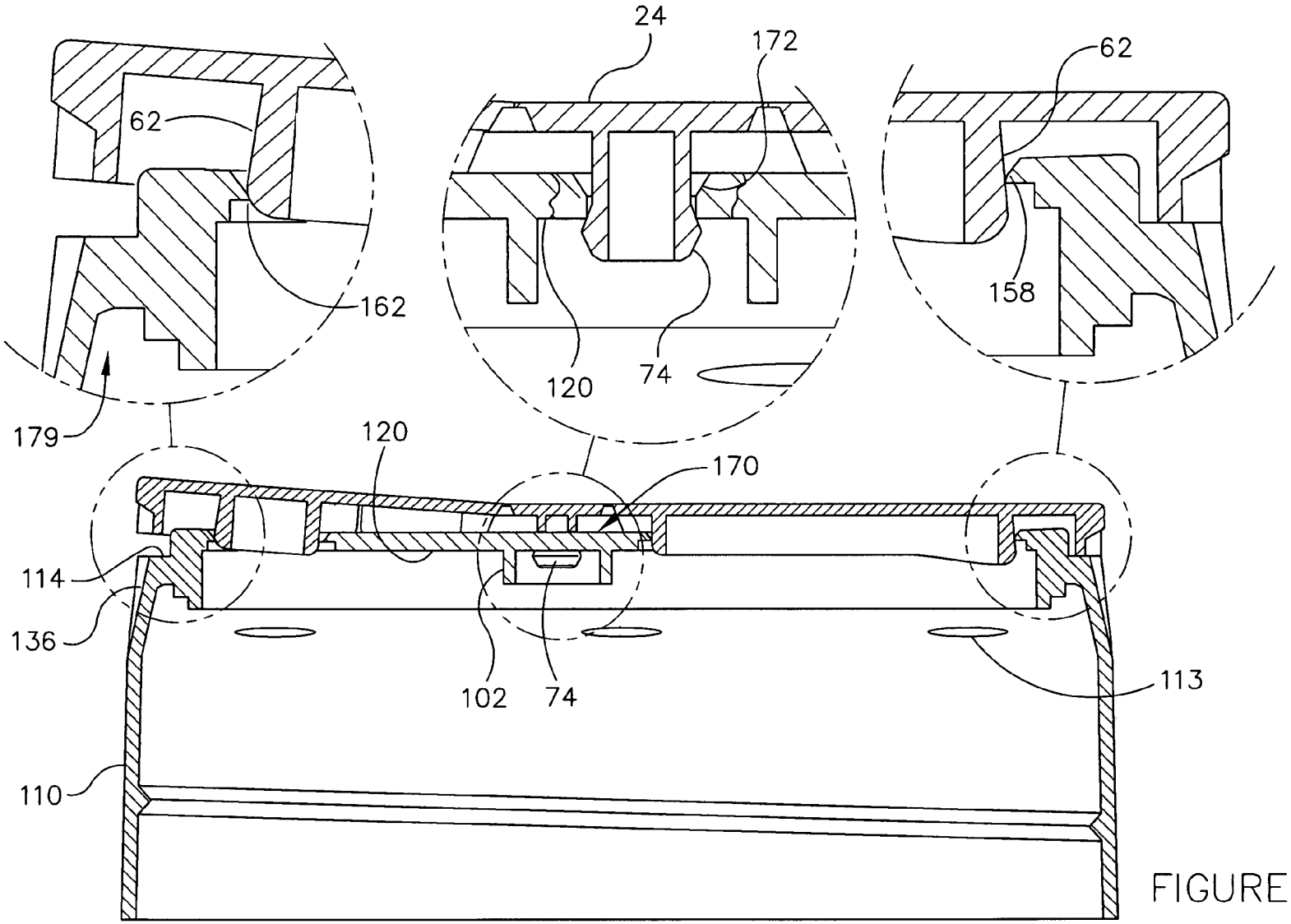
FIG. 8 is a schematic representation of a cross-sectional view of the top portion of the closure for a container of FIG. 6D and the body portion of the closure for a container of FIG. 7D in a coupled configuration.

According to various exemplary and alternative embodiments, various structures may be provided that are configured to urge or bias the flaps into a closed position, or existing structures may be configured to achieve the same result (e.g., as shown in U.S. Pat. No. 6,464,113 which is hereby incorporated by reference herein). As illustrated in FIGS. 7D, 7E, and 8, such structure may comprise a central region of the end wall on the body portion that is formed with a "bowed" or concave surface. When the top portion is coupled to the body portion and one or both of the flaps are moved to an open position, the interior edges of the flaps (proximate the hinge coupling each flap to the central portion of the top portion) tend to deflect the concave surface upward. The concave surface acts as a "flat spring" which has a tendency to return to its original position and to bias the flaps toward the closed position. According to an alternative embodiment, the central region of the top portion may be formed with a concave surface to act as a "flat spring" for biasing the flaps toward the closed position. According to other alternative embodiments, the central region of the end wall of the body portion and/or the central region of the top portion may be formed with a convex surface or other non-flat surface configuration to act as a "flat spring" for biasing the flaps toward the closed position.

According to various exemplary and alternative embodiments, a closure for a container is provided that comprises at least one opening for dispensing material from a receptacle and at least one flap for covering the opening or openings. The closure may be sized to couple to and cover receptacles of different sizes (e.g., a 33 millimeter receptacle, a 38 millimeter receptacle, a 43 millimeter receptacle, a 48 millimeter receptacle, a 53 millimeter receptacle, a 63 millimeter receptacle, a 70 millimeter receptacle, an 89 millimeter receptacle, a receptacle ranging from anywhere between approximately 20 millimeters and 140 millimeters, etc.). According to one exemplary embodiment, the closure comprises a body portion and a top portion that may be separately formed in a "direct-pull" type injection molding operation. The body portion and the top portion comprise coupling structure, such that the body portion and top portion may subsequently be coupled for use as a closure for a container. According to another exemplary embodiment, the body portion and top portion of the closure are integrally formed as a single unitary body in a single mold. According another exemplary embodiment, the top portion comprises a first closure system configured to engage the flap with the inside edge of the opening, and/or may comprise a second closure system configured to engage the flap with an outer edge of the end wall. The first and second closure systems may be used individually or in any suitable combination to provide a strategy for maintaining the flaps in a closed position under conditions that tend to result in opening of the flaps (e.g., distortion due to filling operations, etc.). The bottom portion may comprise a sealing ring or structure to provide a seal (e.g., air-tight or not) between the receptacle and the closure.

It is important to note that the construction and arrangement of the elements of the closure for a container provided in this specification are illustrative only. Although only a few exemplary and alternative embodiments of the present invention have been described in detail in this disclosure, those skilled in the art who review this disclosure will readily appreciate that many modifications are possible in these embodiments (such as variations in features such as orientation of flaps, skirts and corresponding recesses; variations in sizes, structures, shapes, dimensions and proportions of the flaps, recesses, projections, skirts, stiffeners and other elements; variations in the flap hinge arrangements, number of flaps, configuration and operation of flap closure structures and systems, arrangement and proportioning of spoon and shaker openings, use of materials, colors, combinations of shapes, etc.) without materially departing from the novel teachings and advantages of the invention. For example, the closure may be adapted and sized for use on any type of container or receptacle, or for use on containers or receptacles of different sizes, and/or the closure may be used for dispensing a variety of different materials or contents. The body portion and top portion may be adapted for use on a receptacle with a square, rectangular, or other shaped mouth or opening, or the shaker openings may be replaced with a single opening (e.g., a tear-drop, triangular, rectangular, circular, oval, or other shaped opening) and be configured to pour one or more of a variety of different materials, or the shaker openings may comprise a pattern having any number of openings arranged in one or more different shapes. According to other alternative embodiments, the closure may be adapted for coupling to a receptacle by a threaded interface or by a snap-on ring or other press-fit engagement structure. According to other alternative embodiments, the body portion and the top portion, or any combination thereof, may be integrally-formed as a single unitary body or formed separately and coupled together. It is readily apparent that each of the different embodiments and elements of the closure may be provided in a wide variety of shapes, sizes, thicknesses, combinations, etc. It is also readily apparent that the interfaces and structures for closing the flaps may be designed with any profile and configuration suitable for securing the flaps to the body portion. Accordingly, all such modifications are intended to be within the scope of the inventions as defined in any appended claims.

The order or sequence of any process or method steps may be varied or re-sequenced according to alternative embodiments. In any claims, any means-plus-function clause is intended to cover the structures described herein as performing the recited function and not only structural equivalents but also equivalent structures. Other substitutions, modifications, changes and omissions may be made in the design, operating configuration and arrangement of the exemplary and other alternative embodiments without departing from the spirit of the present inventions as expressed in any appended claims.

What is claimed is:

1. A closure for a receptacle of a type having an open top and a closed bottom, the closure comprising:

a body comprising:

a cylindrical side wall having a first open end configured to receive the top of the receptacle and a second end;

an end wall coupled to the second end of the cylindrical portion, the end wall including a plurality of shaker openings and a spooning opening;

a sealing structure having a plurality of distinct and separate sealing rings spaced radially inward from the side wall comprising at least (1) a first ring with a planar sealing surface and provided a first radial distance from the side wall and a first axial distance from the end wall and (2) a second ring with a planar sealing surface and provided a second radial distance from the side wall and a second axial distance from the end wall, the second radial distance being less than the first radial distance and the second axial distance being less than the first radial distance;

a top coupled to the body and having a shaker flap and a spooning flap, the shaker flap having an outer edge with a downwardly extending skirt and being configured for selective movement between an open position in which the shaker openings are opened and a closed position in which the shaker openings are closed, the spooning flap having an outer edge with a downwardly extending skirt and configured for selective movement between an open position in which the spooning opening is opened and a closed position in which the spooning opening is closed; and a transition region having an exposed surface and being located between the sealing structure and the side wall;

wherein the exposed surface extends from a first point on the sealing structure radially inward from the side wall to a second point on the side wall below the end wall and below the first point, the exposed surface not extending above the first point.

2. The closure of claim 1 wherein the exposed surface is curved.

3. The closure of claim 2 wherein the exposed surface forms a radius between the sealing structure and the side wall.

4. The closure of claim 1 wherein the exposed surface is parallel to the second sealing surface of the second sealing ring at the first point, the second sealing ring being an uppermost and outermost sealing ring relative to the end wall and the side wall respectively.

5. The closure of claim 4 wherein the exposed surface is parallel to the side wall at the second point.

6. The closure of claim 1 wherein the transition region is an annular fillet located at the juncture between the side wall and the sealing structure.

7. The closure of claim 1 wherein the body portion and the top portion are separate elements coupled together to form the closure.

8. The closure of claim 2 wherein the exposed surface curves approximately 90 degrees between the first point and the second point.

9. The closure of claim 1 wherein the sealing surfaces are arranged in a step-wise pattern of coaxial surfaces such that a distance from the end wall increases as a diameter of the sealing surfaces decreases.

10. The closure of claim 1 wherein the planar sealing surface of the first ring is configured to fit over a mouth of a receptacle generally having a first diameter and the planar sealing surface of the second ring is configured to fit over a mouth of a receptacle generally having a second diameter, and wherein the first point is located on one of the first ring and the second ring.

11. The closure of claim 1 wherein the axial distance between the first point and the second point is less than approximately 0.125 inches.

12. The closure of claim 1 wherein the transition region extends continuously around the inside of the closure between the sealing structure and the side wall.

13. A closure for a container configured to fit over a generally circular mouth of a receptacle to form a container for particulate matter or the like comprising:

a body portion having an open bottom formed of a cylindrical skirt and an end wall, the end wall defining a first opening and a second opening;

a sealing structure having a plurality of distinct and separate sealing rings spaced radially inward from the skirt comprising at least (1) a first ring with a planar sealing surface provided a first radial distance from the skirt and a first axial distance from the end wall and (2) a second ring with a planar sealing surface provided a second radial distance from the skirt and a second axial distance from the end wall, the second radial distance being less than the first radial distance and the second axial distance being less than the first radial distance;

a top portion having (a) a first flap movable from a closed position where the first opening is covered to an open position where the first opening is at least partially uncovered to allow for matter to be dispensed, and (b) a second flap movable from a closed position where the second opening is covered to an open position where the second opening is at least partially uncovered to allow for matter to be dispensed; and an annular fillet located at the juncture between the skirt and the sealing structure;

wherein the fillet includes an exposed surface extending from a first point on the sealing structure radially inward from the skirt to a second point on the skirt below the end wall and below the first point, the exposed surface not extending above the first point.

14. The closure of claim 13 wherein the exposed surface is curved.

15. The closure of claim 14 wherein the exposed surface forms a radius between the sealing structure and the side wall.

16. The closure of claim 13 wherein the exposed surface is parallel to the second sealing surface of the second sealing ring at the first point, the second sealing ring being an uppermost and outermost sealing ring relative to the end wall and the skirt respectively.

17. The closure of claim 16 wherein the exposed surface is parallel to the side wall at the second point.

18. The closure of claim 14 wherein the exposed surface curves approximately 90 degrees between the first point and the second point.

19. The closure of claim 13 wherein the sealing surfaces are arranged in a step-wise pattern of coaxial surfaces such that a distance from the end wall increases as a diameter of the sealing surfaces decreases.

20. The closure of claim 13 wherein the planar sealing surface of the first ring is configured to fit over a mouth of a receptacle generally having a first diameter and the planar sealing surface of the second ring is configured to fit over a mouth of a receptacle generally having a second diameter, and wherein the first point is located on one of the first ring and the second ring.

21. The closure of claim 13 wherein the axial distance between the first point and the second point is less than approximately 0.125 inches.

22. The closure of claim 13 wherein the body portion and the top portion are separate elements coupled together to form the closure.

23. The closure of claim 13 wherein one of the first opening and the second opening of the end wall is a spooning opening.

24. The closure of claim 13 wherein the fillet extends continuously around the inside of the closure between the sealing structure and the side wall.

25. A closure for a container comprising:

a body having a cylindrical skirt and an end wall, the cylindrical skirt having a first end coupled to the end wall and a second open end configured to receive a receptacle;

a sealing structure having a plurality of distinct and separate sealing rings spaced radially inward from the skirt comprising at least (1) a first ring with a planar sealing surface provided a first radial distance from the skirt and a first axial distance from the end wall and (2) a second ring with a planar sealing surface provided a second radial distance from the skirt and a second axial distance from the end wall, the second radial distance being less than the first radial distance and the second axial distance being less than the first radial distance;

a top portion coupled to the end wall of the body portion and having a flap movable from a closed position where the opening is covered to an open position where the opening is at least partially uncovered; and a transition region having an exposed surface and being located at a juncture between the sealing structure and the skirt;

wherein the exposed surface extends from a first point on the sealing structure radially inward from the skirt to a second point on the skirt below the end wall and below the first point, the exposed surface not extending above the first point.

26. The closure of claim 25 wherein the exposed surface is curved.

27. The closure of claim 26 wherein the exposed surface forms a radius between the sealing structure and the skirt.

28. The closure of claim 25 wherein the exposed surface is parallel to the second sealing surface of the second sealing ring at the first point, the second sealing ring being an upper most and outermost sealing ring relative to the end wall and the skirt respectively.

29. The closure of claim 28 wherein the exposed surface is parallel to the skirt at the second point.

30. The closure of claim 25 wherein the transition region is an annular fillet located at the juncture between the skirt and the sealing structure.

31. The closure of claim 25 wherein the body portion and the top portion are separate elements coupled together to form the closure.

32. The closure of claim 26 wherein the exposed surface curves approximately 90 degrees between the first point and the second point.

33. The closure of claim 25 wherein the sealing surfaces are arranged in a step-wise pattern of coaxial surfaces such that a distance from the end wall increases as a diameter of the sealing surfaces decreases.

34. The closure of claim 25 wherein the planar sealing surface of the first ring is configured to fit over a mouth of a receptacle generally having a first diameter and the planar sealing surface of the second ring is configured to fit over a mouth of a receptacle generally having a second diameter, and wherein the first point is located on one of the first ring and the second ring.

35. The closure of claim 25 wherein the axial distance between the first point and the second point is less than approximately 0.125 inches.

36. The closure of claim 25 wherein the transition region extends continuously around the inside of the closure between the sealing structure and the skirt.

* * * * *

UNITED STATES PATENT AND TRADEMARK OFFICE

CERTIFICATE OF CORRECTION

PATENT NO. : 8,100,303 B2
APPLICATION NO. : 11/317649
DATED : January 24, 2012
INVENTOR(S) : Terrence M. Parve It is certified that error appears in the above-identified patent and that said Letters Patent is hereby corrected as shown below:

ON THE COVER PAGE

In the first column, for (73) Assignee, replace "Gatewat" with --Gateway--.

Signed and Sealed this
First Day of May, 2012

David J. Kappos

David J. Kappos
*Director of the United States Patent and Trademark Office*